United States Patent [19]

Godfrey

[11] Patent Number: 4,995,435

[45] Date of Patent: Feb. 26, 1991

[54] APPARATUS FOR AND METHOD OF CUTTING JOINTS

[76] Inventor: Christopher M. V. Godfrey, The Old School, Godney Wells, Somerset BA5 1RY, Great Britain

[21] Appl. No.: 439,633

[22] Filed: Nov. 21, 1989

[30] Foreign Application Priority Data

May 22, 1987 [GB] United Kingdom ..... 8712094
Feb. 12, 1988 [GB] United Kingdom ..... 8803340

[51] Int. Cl.[5] ..... B27B 1/00
[52] U.S. Cl. ..... 144/363; 144/87; 144/144 R; 144/144 S
[58] Field of Search ..... 409/130; 144/85, 87, 144/144 R, 144 S, 200, 371, 372

[56] References Cited

U.S. PATENT DOCUMENTS 3,272,244 9/1966 Memec ..... 144/87
4,428,408 1/1984 Grisley ..... 144/87

FOREIGN PATENT DOCUMENTS 369776 3/1932 United Kingdom .
1128998 10/1968 United Kingdom .

*Primary Examiner*—W. Donald Bray
*Attorney, Agent, or Firm*—Reed Smith Shaw & McClay

[57] ABSTRACT

An apparatus for machining at least one half of an interconnecting joint between the end regions of two components has a support, a carrier which is movable and fixable with respect to the support, a cutting means which is mounted on the support for machining the end of a component and a datum point. The carrier has two clamps for separately clamping first and second components. A first one of the components is held in a first clamp and is machined by the cutting means to a first profile. The resultant machined part is then removed and replaced by a second part with the machined part being transferred to the second clamp which is positioned adjacent the datum point to act as a template. The second component is now machined to a profile capable of corresponding with the previously machined profile of the first part. The present invention is particularly suited for the machining of dovetail joints.

16 Claims, 7 Drawing Sheets

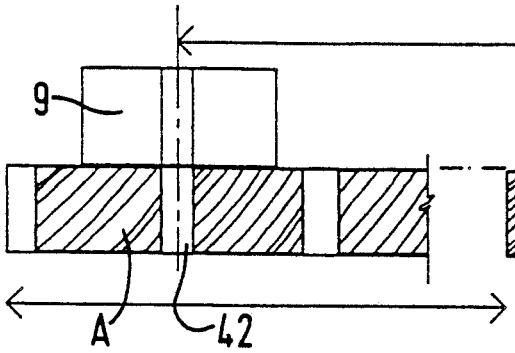
FIG. 5.
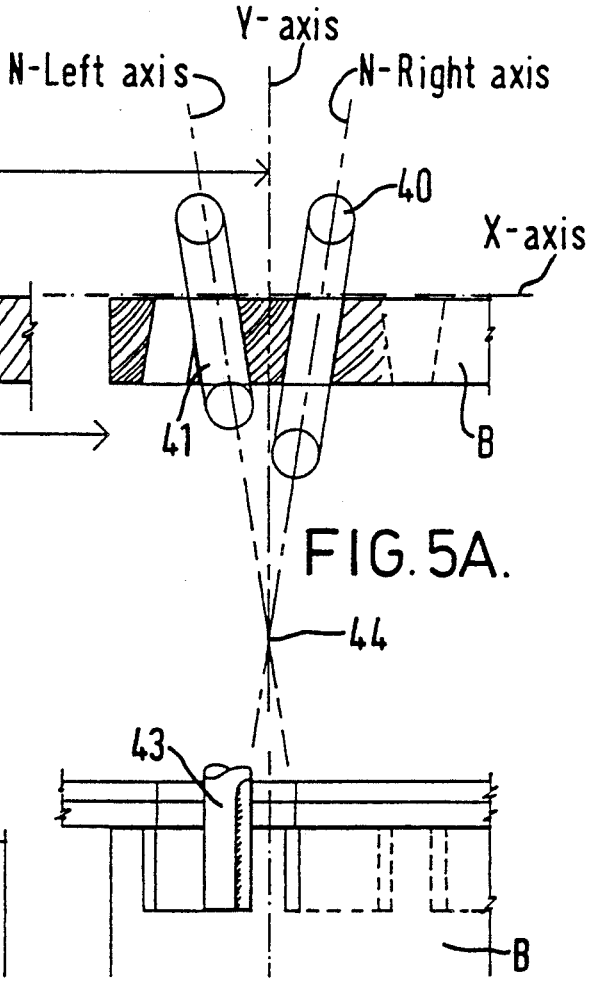
FIG. 5A.
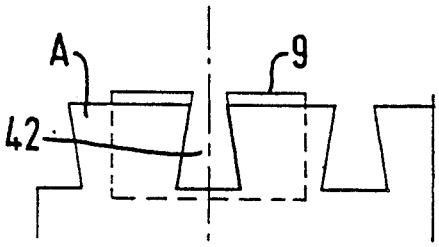
FIG. 6.
FIG. 6A.
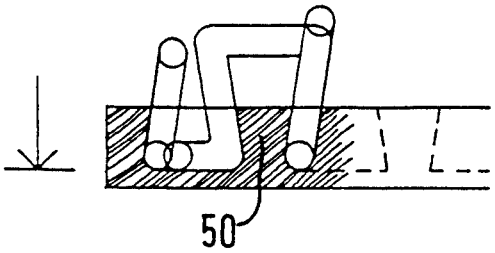
FIG. 7.

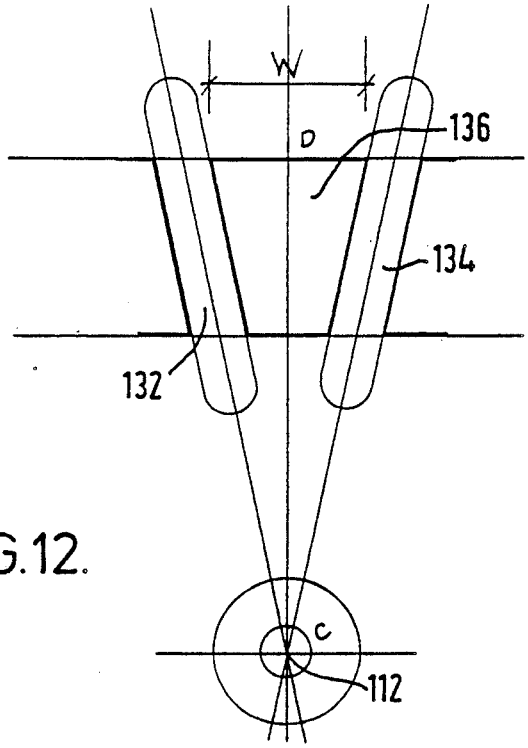
FIG.12.
FIG.13a. FIG.13b. FIG.13c.
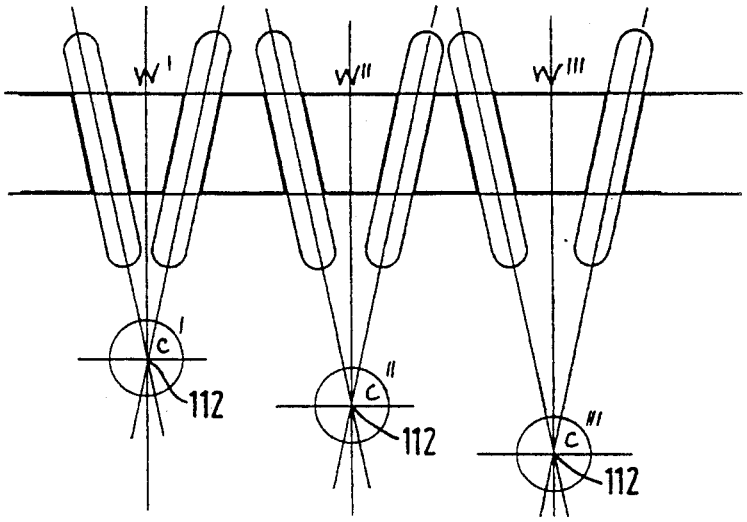

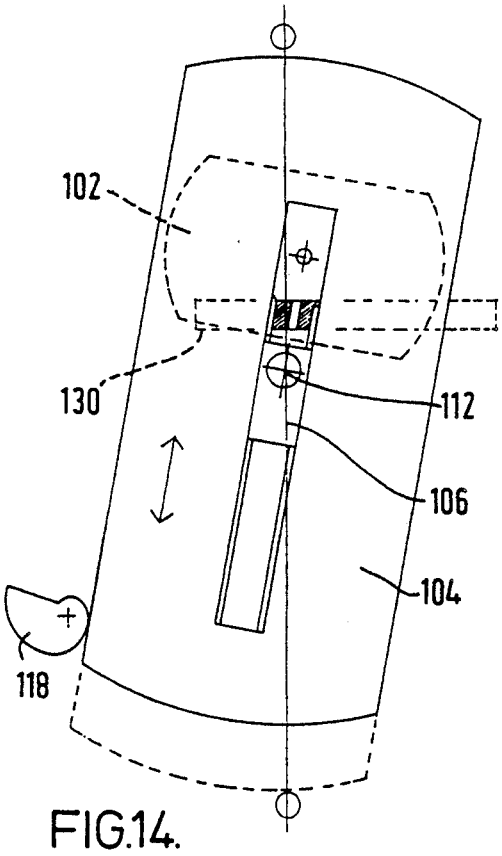
FIG.14.
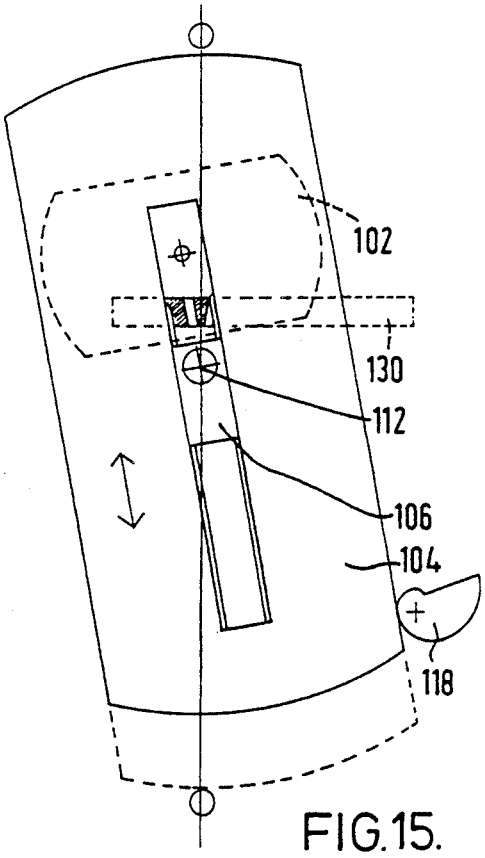
FIG.15.
FIG.16.
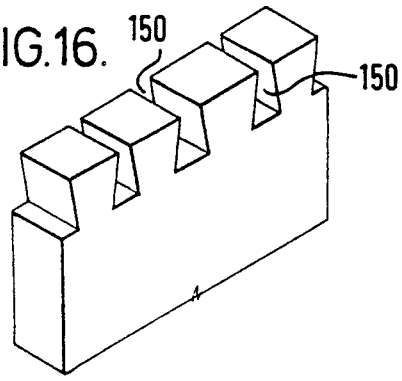
FIG.17.
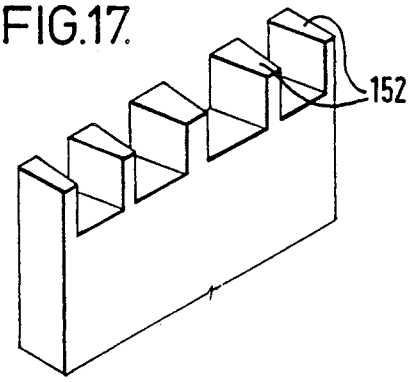

APPARATUS FOR AND METHOD OF CUTTING JOINTS

This is a continuation-in-part of copending application International Application No. PCT/GB88/00404 filed on May 23, 1988 and which designated the U.S.

This invention relates principally to an apparatus for and a method of cutting joints in material such as wood and is more particularly, but not exclusively, concerned with cutting dovetail joints. In addition to its use as a dovetail joint cutting apparatus, the apparatus may also be used for cutting halving joints, for rebating and grooving; however, dovetails are among the most difficult of all joints to execute well, and the apparatus and method of the present invention bring craftsmen-like dovetail joints within the ambit of most wood-working enthusiasts.

A dovetail joint is a joint, for instance right-angled joint, between two components, normally wooden components. In the type of dovetail joint with which the present invention is concerned, one of the components has and end region comprising an alternating series of fish-tail or dove-tail shaped projections and inverted fish-tail or dove-tail spaces, when the component is viewed in elevation. The other component has an end region comprising a series of pins and spaces of a configuration such that it can mate, for example, at right angles, with the one component. Thus, when the end of the other component is viewed in plan, the pins appear as truncated wedges separated by similarly shaped, but oppositely disposed, spaces.

Proper dovetail joints are not generally used on commercial work because they are not economic to cut. Machines are in existence which work on the principle of guiding the dovetail-shaped bit of a router between a series of regularly spaced tynes in a jig to cut the dovetails and pins simultaneously. Dovetail and pin are identical, which gives an unmistakable machined appearance to the work. The only acceptable joint in appearance is the lapped or recessed dovetail; however, the bottom of the tail is rounded and not square, and, thus, the machined lapped dovetail is not inherently a very strong joint. A development of this machine has been made (see EP-No. 0077143) whereby the tynes have been made adjustable. When different dovetail spacing is required, the tynes must be reset.

According to a first aspect of the present invention, there is provided an apparatus for machining at least one half of an interconnecting joint between the end regions of two components, the apparatus comprising:

a support;

a carrier movable on and fixable with respect to the support and having a first clamping means, for clamping to the carrier a first component for machining of that component, and a second clamping means for clamping a second component, having a previously machined end profile, to the carrier in a predetermined position to act as a template to enable the end region of the first component to be machined to a profile capable of co-operating with the second component;

a cutting means mounted on the support for machining the end of the component; and means defining a datum point;

the arrangement being such that, in use, when the second component is sequentially held by the second clamping means in a series of predetermined positions in relation to the means defining a datum point, the first component to be machined is correspondingly held in a series of positions in relation to the cutting means whereby the end of the first component is capable of being machined by the cutting means to a profile capable of co-operating with the profile of the second component.

According to a second aspect of the present invention, there is provided an apparatus for machining at least one half of an interconnecting dovetail joint between the end regions of two co-operating components comprising:

a support:

a carrier movable and fixable with respect to the support and having a first clamping means for clamping to the carrier a first component for machining of that component, and a second clamping means for clamping a second component, having a previously machined end profile comprising a series of dovetail shaped slots, to the carrier in a predetermined position to act as a template to enable the end of the first component to be machined to a profile having a series of pins capable of co-operating with the profile of the second component;

cutting means for machining the pins in the said first component, said cutting means being mounted on the support such that it is movable in a plane perpendicular to the plane of the carrier and at angles inclined to the plane of the carrier; and means defining a datum point;

the arrangement being such that, in use, when the second component is sequentially held by the second clamping means in a series of predetermined positions in relation to the means defining a datum point, the first component to be machined is correspondingly held in a series of positions in relation to the cutting means whereby the end of the first component is capable of being machined by the cutting means to a profile capable of co-operating with the profile of the second component.

According to a third aspect of the present invention, there is provided a method of machining at least one half of an interconnecting joint between two components which comprises the steps of:

(a) clamping a first component to be machined to a carrier movable and fixable with respect to a support and clamping to the carrier, at a location spaced from the first component, a second component which has a previously machined profile to which a mating profile is to be machined in the first component, the second component being clamped to the carrier in a manner such that its machined profile lies in a first predetermined position against a datum point on the support;

(b) fixing the carrier with respect to the support and machining a first region of the end of the first component using a cutting means mounted on the support;

(c) adjusting the position of the carrier with respect to the support such that the profile of the second component lies in a further predetermined position against said datum point;

(d) fixing the carrier with respect to the support in the adjusted position and machining a second region of the profile of the first component using the said cutting means; and (e) repeating steps (c) and (d) until the whole of the profile of the first component has been machined.

According to a fourth aspect of the present invention, there is provided a method of machining at least one half of an interconnecting dovetail joint between the end regions of two components which comprises the steps of:

(a) clamping a first component to be machined on a carrier movable and fixable with respect to a support and clamping to the carrier, at a location spaced from the first component, a second component which has a previously machined end profile comprising a series of dovetail-shaped slots to which a mating profile is to be machined in the first component, the second component being clamped to the carrier in a manner such that its previously machined end profile lies in a first predetermined position against a datum point on the support;

(b) fixing the carrier with respect to the support and machining a first region of the profile of the first component using a cutting means mounted in the support;

(c) adjusting the position of the carrier with respect to the support such that the profile of the second component lies in a further predetermined position against said datum point;

(d) fixing the carrier with respect to the support in the adjusted position and machining a second region of the profile of the first component using the cutting means; and (e) repeating steps (c) and (d) until the whole of the profile of the first component has been machined.

Whilst it is appreciated that normally the carrier will be movable on the support, it is also to be appreciated that the carrier carrying the clamps could be fixed and the support, carrying the datum and cutting means, made to be movable on the carrier.

The second component may have a profile which has been previously machined using the apparatus of the invention with the second component in the first clamp.

The dovetail cutting apparatus of the present invention does not have the disadvantages from which the known machine described above suffers. It can produce proper full dovetails identical to the traditional handmade dovetail. In addition the spacing of the dovetails may be as the operator wishes, and the pins and the tails may be as wide or narrow as necessary or desired without resetting the machine. The dovetail cutter can also work at very small thicknesses (e.g. 5 mm thickness) for drawers in cabinet work, whereas the prior dovetail jig needs at least 15 mm timber to function.

Operation of the apparatus of the invention is simple. A first component of the joint is fixed vertically, with the end to be machined uppermost against a sliding carrier and a dovetail router bit is drawn horizontally through the component end to make the dovetail slots, advancing the sliding carrier between each cut.

The cut first component is then placed in a second position on the carrier against a marker or datum. The second component to be cut is offered up to the router, the cutter changed for a conventional cylindrical cutter, and the pins cut in relation to the dovetail cuts in the first component, which is used as a template. This time, the cutter may be supported on a turntable and the cuts may be made at an angle across the end of the component.

As in hand-cut work, the dovetails can be cut in any position along the end of the second component that the operator wishes. This is often essential, when making boxes for example, where a saw cut may have been made, or may need to be made between the box and the lid, or for drawers where the placing of the front dovetails differs from the back ones.

No marking out is necessary. Accuracy derives from the machine and the cut first component. The operator decides the positioning of the dovetails, and everything follows from there.

For the 90 degree cut of the dovetail slots, several boards can be cut at once, saving time and preventing wood breakout.

The depth of the dovetails is limited by the size of the dovetail bit available. However, there is no limit to the thickness of board which can be jointed, as a rebated dovetail joint can be easily made by sliding the board across the locked router bit.

An apparatus in accordance with the invention may be wall-mounted for a firm fixing, and to save workshop space, and so that it can be placed at any height to process any length of board. The machine can theoretically be any size, to work any width of wood.

The sliding carrier is aligned in the support with its face defining an X-axis. The inner face of the component to be machined is placed against the carrier and the face of the carrier is therefore a datum.

The carrier may be held along its top and bottom edges by two fixed guides, which may be mitred in section, and which may fit into mitred section grooves in the carrier.

The method of sliding the carrier can be more or less sophisticated, as required. It can be moved manually or pneumatically, or racked along with wheel and worm, or a wire and drum system. It is important that the bar does not move, i.e. is locked or fixed relative to the support, once the position is set.

The components may be held on the carrier against a fixed jaw by a movable cammed jaw. The cammed jaw may slide in a channel in the carrier in such a way that the component can be offered up to the jaws and quickly and firmly locked into place with the cam pushing the movable jaw against the component. Teeth in a channel in the face of the carrier mesh with dogs on the cam plate to prevent the movable jaw slipping away from the component as the cam tightens. As there may be a lot of interchanging of components, they need to be placed quickly, and loosened instantly that the cam is slackened, releasing the component. One manifestation of the cam has the movable jaw formed behind the cam so that it is pulled away as the cam is adjusted.

The cam-clamp slides in the channel of the bar. The profile of the channel can be cut by a standard router bit. This means that this type of clamp can be used as a clamp independently of the cutter, using a rail cut with bit to match the profile of the channel. The rail can be cut using the machine so that the machine can cut its own clamps in any length of timber. This is important as it is necessary to glue up as soon as the joints are cut to avoid problems with timber movement.

Any make of router may be employed. The router may be mounted on a base plate in a manner such that it can slide forwards and backwards in relation to a piece of material to be cut in the cutting position and also may be rotatable around a centre point so that angled cuts may be made. The mounting of the router may be achieved in various ways. For instance, the router may be mounted on a platform or turntable rotatable within the base-plate, the base-plate itself being moveable forwards and backwards, sliding between two router plate guides. The router is secured to the turntable so that it may be rotated, and locked in position, at a variety of angles. A locking mechanism may be provided on the guides to fix the router for grooving and rebating. Another possibility for mounting the router is to make the base-plate fixed in relation to the support and provide a router plate on which the router is mounted and which slides on the base plate forwards and backwards. In this embodiment, the router plate is rotatable about an axis, the position of which is adjustable. Means, such as adjustable stops, may be provided for limiting the rotation about the axis.

A stop on the guides allows the bit to travel forward through the work to a given position (for lapped or recessed dovetails).

In the embodiment having a turntable, the router plate guides are fixed to the turntable allowing the router to be drawn forward at an angle, either to the right or to the left.

The turntable can be set at a predetermined angle against a pin placed in the baseplate, or the pin can go through the guide into the baseplate to fix it. Therefore at 90 degrees it is possible to make the dovetail cut or rout a straight groove. Alternatively, the base plate can swivel between stops to allow quick changes between left and right cuts, for making the pins in the second component. Waste can be cut away with a sweeping action of the router between these stops. This is to clear areas between the pins. Clearing is done in a clockwise direction to avoid breakout since the bit of the router is likely to rotate clockwise.

The platform or turntable may be set in the baseplate. The baseplate itself can be moveable forwards and backwards on the Y-axis by the rack and pinion. This alters the distance from the centre of the turntable circle to the face of the carrier.

For cutting dovetail pins at a given angle, the further forward the base plate is, the wider is the spread of the left and right cuts at the face of the board against the carrier (at datum), and vice versa.

The accuracy of the pins can be very finely adjusted giving a tight fit for softwoods and a precise fit for hardwoods.

There are two positions on the carrier for the components: a cutting position and a marker position.

To make a marker, a block is placed in a housing immediately behind the carrier in the cutting position and a slot is routed into it with the dovetail bit. This machined block is taken out and fixed into the housing or support behind the carrier in the marker position. It is used to determine the exact position of the cuts for the pins. A block is made for each router bit size.

The distances from marker to the cutter and from clamp to clamp are equal so a dovetail placed against the marker block will correspond exactly to the position for the pin in the cutter position. As the dovetails are moved against the marker block so each pin position will be correctly placed.

Locating the exact line-up between the two dovetail cuts of board and marker is easy for large dovetails because it can be felt with the finger. A light behind the block makes the line-up visible, or a feeler stick the exact size of the dovetail gives positive mechanical positioning.

The dovetails are cut first, using the dovetail bit. The turntable is fixed at 90 degrees (Y-axis), and the correct depth is set. An upright blank board is set in the marker position and the dovetails are marked on it. The first mark is set against the marker block, and the dovetail is cut in the board in the cutter position. The carrier is slid along to correspond to the next mark against the marker, the next cut is made, and so on until all dovetails are cut. Maybe four or six boards can be cut at once depending on the thickness of the timber.

A board with dovetails is then placed in the marker position so that the cut dovetails can match exactly the slot in the marker block. This board is used as a template for the corresponding pins.

In cutting the pins, the bit is changed to a straight bit, and set to the correct depth. The turntable is freed, and stops placed in the base plate for the angle of the dovetail in use. The router can now swing left to the correct angle, and right (N-left and N-right) behind the bar, and be drawn forward through the work, thus making the pin.

To determine the exact fit for the type of wood used, a test may be made with a narrow piece of scrap. A dovetail in the dovetailed board is placed against the slot in the marker block, and the test piece is placed in the cutter position. Two cuts are made on N-right and N-left without moving the bar, making the two sides of the pin.

If the resultant pin is too small the baseplate is brought forward, and if too large the plate is moved away, and the process re-tried until the fit is exact. This setting is then kept for all work with that cutter.

The proper component in which the pins are to be cut is now offered up to the cutter position.

The carrier is slid along to correspond the first dovetail to the marker block. At this position a cut on N-right alone will make the corresponding pin on the edge of the board.

The board is slid to the next dovetail position. The pin is again cut, making N-right first, then N-left. The waste is then removed between the cut just made and the N-right cut of the previous pin. This is repeated until all the pins are cut.

The two boards, dovetails and pins will now fit with a firm push.

Lapped dovetails are made in the same manner as the ordinary dovetails, but the pins are made with a keeper in place on the router plate guides, to prevent the bit travelling forward though the board beyond the depth of the dovetail. They have rounded corners which need to be squared up with a chisel later, using the routed cuts as guide.

Mitred dovetails can be formed using the keeper in place for the dovetail as well as the pin. The router is then run along the top of the board to form a square rebate on both, and the remaining nib is mitred with a conical router bit. The rounded corners are squared up using a chisel as before.

Using a straight router bit, halving joints and comb joints can be made. Slots can be cut by holding the work beneath the router, and drawing the router across it.

By fixing the router, grooves can be routed for panels and lids and bottoms. This means that the whole drawer, with dovetails, and lapped dovetails, as well as grooves for the drawer bottom can be fashioned on the one machine. Rebates can be made for fielded panels, inlay, and many other uses.

Limitations on the depth of the dovetail are imposed only by the size of the router bit and the power of the router. However, there is no limit to the thickness of board to be jointed, as a rebated dovetail joint can be easily made by sliding the board across the locked router, or using radial arm saw to rebate the board.

A version can be made with two cutters. The marker is replaced be a second router on a baseplate, but without a turntable. One cutter has the dovetail bit which first cuts the tails, and immediately the pins are made without moving the carrier.

This has the following advantages;

1. The two cuts may immediately follow each other allowing no time for the wood to move.

2. That time would be saved by not having to change the cutter blade between cutting dovetail and pin.

3. Hairline accuracy is possible, as the exact position would be given for the pin cut direct from the dovetail cut, without the operator having to judge it.

4. Accuracy is further maintained as the depths of cut could be kept set throughout the cutting, and not altered on change of cutter.

It is a very simple matter to link the two routers and the carrier so that the hand action can be performed mechanically, so that they cut simultaneously, further reducing the cutting time.

For a better understanding of the present invention and to show how the same may be carried into effect, reference will now be made, by way of example only, to the accompanying drawings in which.

Figure 1:
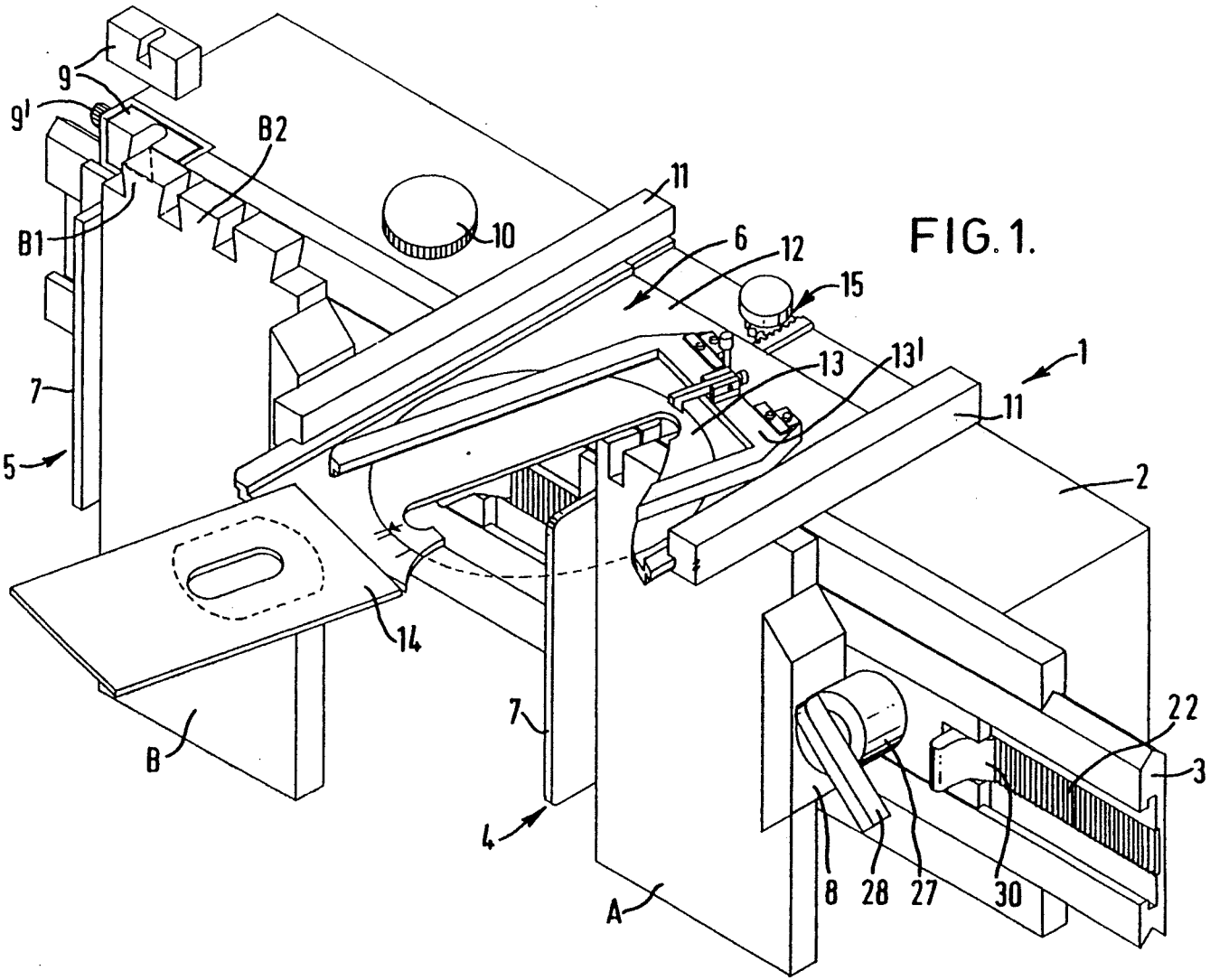
FIG. 1 illustrates an apparatus in accordance with the present invention.
Figure 8:
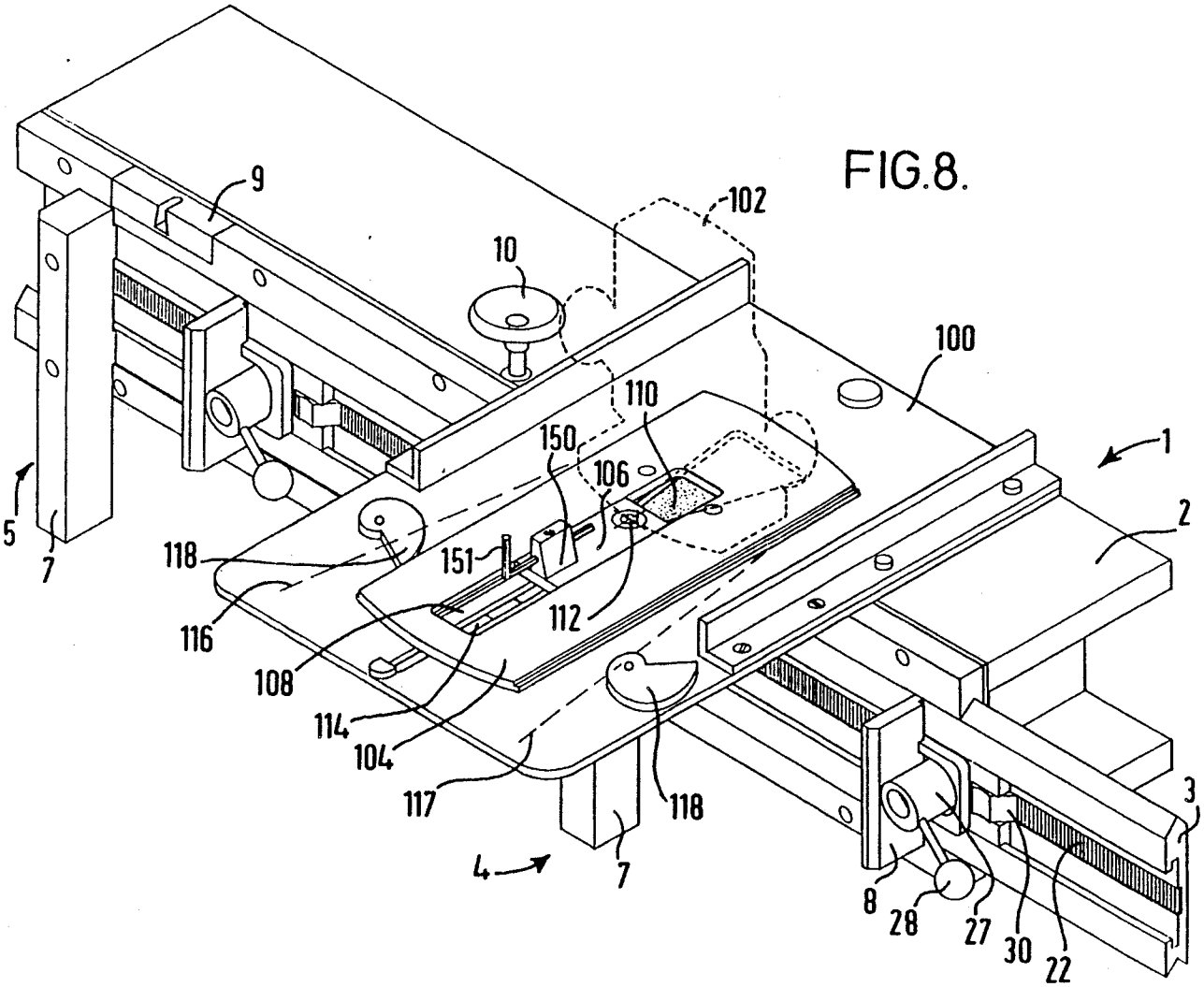
Figure 9:
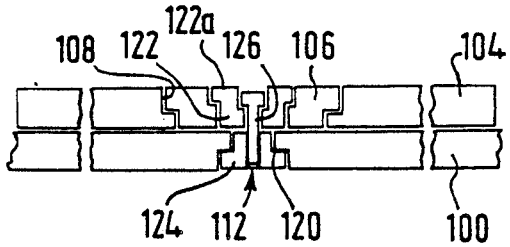
Figure 10:
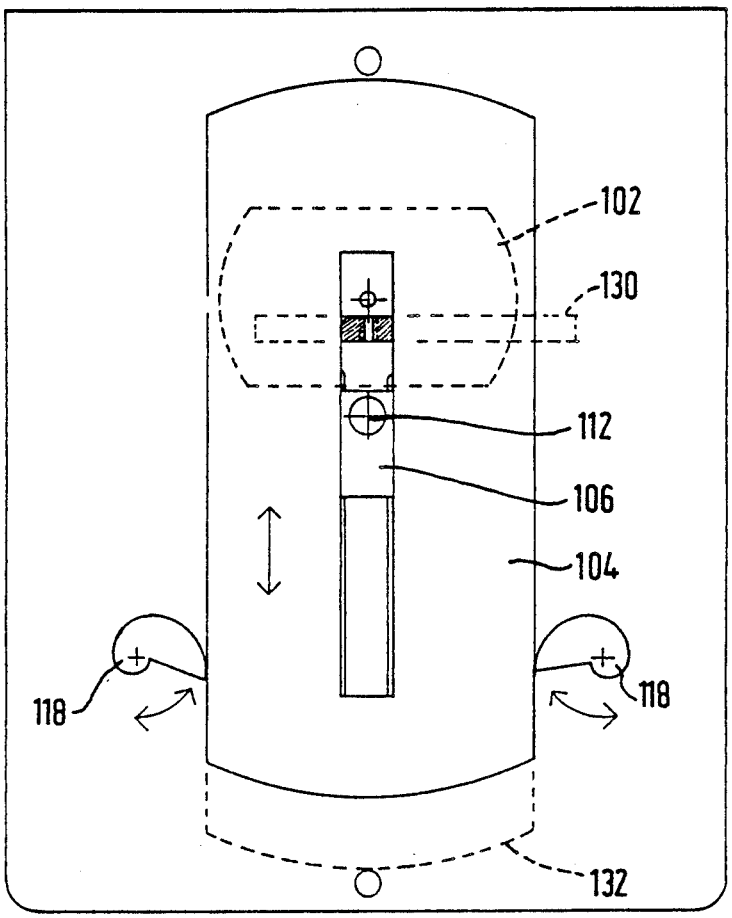
Figure 11:
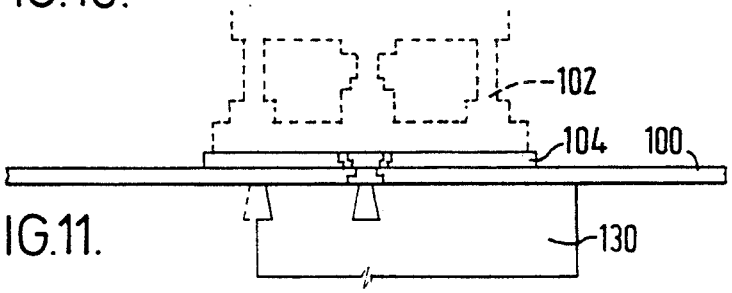

FIGS. 5*a* and 5*b* and FIGS. 6*a* and 6*b* illustrate the manner in which the dovetails and pins are cut;

FIG. 7 shows how a recessed dovetail pin would be cut;

FIG. 8 illustrates an apparatus in accordance with the present invention showing an alternative mechanism for mounting and moving the router;

FIG. 9 is a cross-section through the apparatus of FIG. 8 illustrating the various plates supporting the router at the pivot point;

FIG. 10 is a plan view of the router mounting mechanism of the apparatus shown in FIG. 8;

FIG. 11 illustrates how a dovetail slot is cut using the apparatus shown in FIG. 8;

FIG. 12 illustrates the cuts required in forming a dovetail pin;

FIGS. 13*a*, 13*b* and 13*c* illustrate how the width of the dovetail pin may be adjusted;

FIGS. 14 and 15 illustrate how the right and left hand cuts for a dovetail pin are made using the apparatus shown in FIG. 8; and FIGS. 16 and 17 illustrate end profiles of boards cut with dovetails and pins respectively using the apparatus of FIG. 1 or FIG. 8.

FIG. 1 illustrates a dovetail cutting apparatus 1 comprising a support 2, a movable, linear carrier 3, a first clamp 4, a second clamp 5 and mounting means 6 for a cutting implement (not shown). The clamps 4 and 5 are identical in construction and each comprise a first jaw 7 and a second jaw 8. All four jaws are movable along the carrier 3 and may be locked at various positions. Each of the first jaws 7 is integral with the carrier 2 and are set at a predetermined spacing from the other jaw. Each of the second jaws 8 is capable of locking a component A, B, against the first jaw 7 in the gap between the jaws. Operation of the movable jaw 8 is described in more detail with reference to FIGS. 3 and 4.

The first clamp 4 is adapted to clamp a first component A in position (the cutting position) under the cutter mounting means 6 whilst the second clamp 5 is adapted to secure a second component B in a position (the marker position) in relation to a datum or marker 9 held in a slot in the support by an adjustable screw 9'.

A knurled knob 10 is provided which is connected by wires to the carrier 3 for moving the carrier 3 along the support 2. The gearing of the wiring is such that the carrier 3 will only move when the knob 10 is turned and not the reverse. The carrier 2 is, therefore, effectively locked or fixed in position when it is moved, by the knob 10, to a new location on the support 2.

The mounting means 6 for the router (not shown) comprises two outer grooved rails 11, a base plate 12, a turntable 13 having an upper housing 13' and a sliding plate 14 on which the router is mounted. The base plate 12 is held in the grooves in the rails 11 and supports the turntable 13 and housing 13'. The sliding plate 14 slides in the housing 13'. The base plate 12 may be moved in a direction perpendicular to the carrier 3 by a rack and pinion mechanism 15. Moreover, the turntable 13 and associated housing 13' may be set at selected angles inclined to the plane of the carrier 3 dependent upon the angles of the dovetails cut in the component B in the marker position. The sliding plate 14 carrying the router is then slid in the housing 13' across the end of the component A supported in the first clamp 4 to cut a slot therein. Straight slots may be cut if the turntable is set at 90° to the plane of the carrier 3, whilst inclined slots may be cut if the turntable 12 is inclined to the carrier 3.

In use of the device, a series of dovetails is first cut by setting the turntable 13, 13' perpendicular to the plane of the carrier. A dovetail router is then passed through the end region of the component supported in the first clamp 4 a series of times to produce a series of dovetail-shaped slots such as shown in the end of the component B in FIG. 1 in the marker position. The component B having the cut dovetails is then placed in the second clamp 5 in the marker position adjacent the marker 9 and the first dovetail shaped slot B1 is aligned with the marker 9. The turntable 13, 13' is then slackened from its position perpendicular to the carrier 3 and is moved to an angle inclined to the carrier, this angle being dependent upon the angle of the dovetail router used in cutting the dovetails in the component B. A cylindrical router bit is then passed across the end of component A at this inclined angle and the turntable is then rotated to an angle inclined to the perpendicular but on the opposite side of the perpendicular to the first cut and a further slot is cut at an angle to the end of the component A. The material between the two cuts is then removed by the router in a conventional manner to yield a groove between which the sides of two pins are defined.

The carrier 3 is then advanced such that the end region of the component B lies in a second position against the marker 9 with a second dovetail B2 against the datum. The component in the first clamp 4 is then machined as above to produce a further groove defining the opposite edge of the pin already machined and a first edge for another pin. This procedure is repeated until all the pins have been cut.

Figure 2:
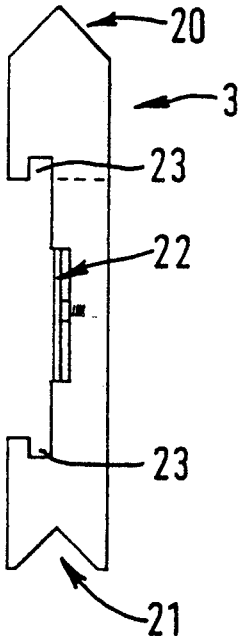
FIG. 2 is a cross section through the sliding carrier of the apparatus shown in FIG. 1.

The carrier 3 is shown in cross-section in FIG. 2. The carrier 3 has an upper angled end 20 and a lower grooved end 21. The angled end 20 and groove 21 are received by cooperating parts in the support 2 which permits the carrier to slide longitudinally. The carrier 2 has a toothed track 22 for locking the moveable jaws which are carried on the carrier 3. The jaws are held in the carrier by the square grooves 23 between which is defined a track 24. A movable jaw 8 is shown in FIG. 3.

The jaw 8 slides in the track 24. The jaw 8 has a first part 25 which is loosely supported on a housing 26 by a cam 27 which is rotatably fixed to the housing 26 and which has a handle 28. As the handle 28 is turned, the rotatable cam 27 urges the first part 25 of the jaw to the left into a buttment with a component held in the gap between the jaws.

Figure 3:
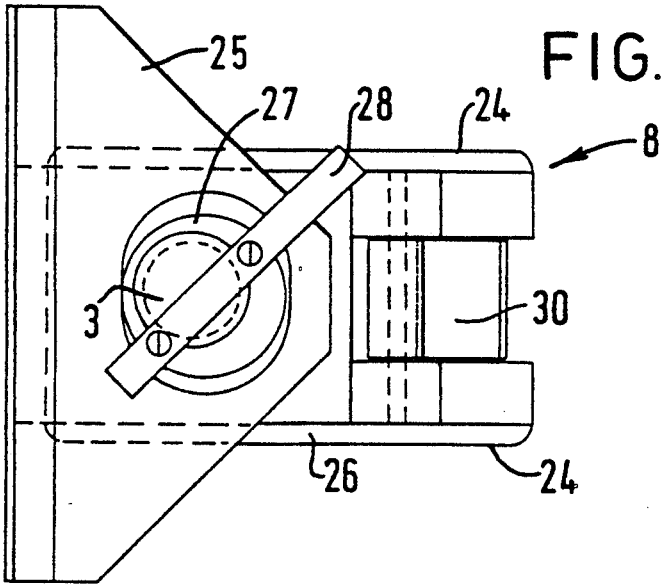
FIG. 3 shows the movable jaw of the clamping means shown in the apparatus illustrated in FIG. 1.
Figure 4:
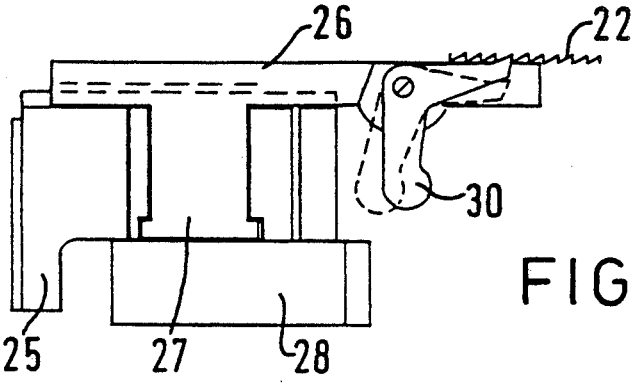
FIG. 4 is a cross section through the jaw shown in FIG. 3.

In FIG. 4, which is a cross-section through the jaw shown in FIG. 3, the mechanism by which the movable jaw 8 may be secured to the carrier 23 is shown. This mechanism comprises the row of teeth 22 on the carrier 3 and a sprung dog 30 which engages, in ratchet-like fashion, the teeth 22 on the carrier 3 to lock the movable jaw 8 in relation to the carrier 3.

FIGS. 5 and 5*a* illustrate, in plan, the upper edges of two components (A and B) in the apparatus of the present invention, spaced apart on the carrier 3. The apparatus itself is not shown. FIGS. 6 and 6*a* illustrate the end regions of the components shown in FIGS. 5 and 5*a* in elevation. Thus, the left hand component A which is the template component in the marker position is aligned so that one of the dovetail slots is aligned with the marker 9. Using the apparatus shown in FIG. 1 two cuts may be made in the component B using router 43; one the N-right axis cut which is identified by reference numeral 40, the other being the N-left axis identified by the reference numeral 41. These cuts are made with the turntable at the same angle but to either side of the Y-axis. The material between the cuts constitutes the pin which will fit into the dovetail slot 42 shown in FIGS. 5 and 6. From FIG. 1, it will be understood that the router is supported on the turntable and pivots about a centre point 44 (shown in FIG. 6A). This centre point 44 can be moved forward and backward by moving the base plate 11 in FIG. 1 generally backwards or forwards. This alters the width of the dovetail pin created and thus, before cutting the dovetail pins, the position of the baseplate, hence the centre point 44 must be determined empirically using scrap material.

In FIG. 7, the passage of a router for cutting recessed pins is shown. In this embodiment, the router does not pass completely through the end region of the wood, only through a portion thereof there to give a pin which does not extend across the entire width of the component.

The apparatus illustrated in FIG. 8 is similar to that shown in FIG. 1, and the same reference numerals are used to represent corresponding components. However, a different mounting arrangement for the router is shown. In this enbodiment, a base-plate 100 is provided as with the embodiment of FIG. 1, but this base-plate 100 is fixed in relation to the support 2. The router (shown by a dotted outline 102) is secured to a router plate 104 which is movable in a controllable manner with respect to the base plate 100. The router 102 may, for instance, be screwed to the router plate 104. The cutting bit (not shown) of the router 102 extends through a suitably shaped aperture 110 in the base plate 100 so that cutting of a part in the cutting position of the apparatus may be accomplished. The router plate 104 is rotatable on the base-plate 100 about a pivot point 112 and this pivot point 112 is capable of being moved backwards and forwards to a selected position and locked in that position. The router plate 104 is secured to the upper surface of the base plate 100, whilst still permitting the router plate 104 to move backwards and forwards and to rotate, as follows, reference being made to FIGS. 8 and 9. The baseplate 100 is provided with a stepped, or inverted T-shaped groove 120 (see FIG. 9) which groove is mirrored, albeit on a larger scale, by an upper stepped groove 108 in the router plate 104. A centre plate 106 having a profile to cooperate with the upper stepped groove 108 is received in the groove 108 and may, in some circumstances, be permitted to slide in the groove (see above). Normally., however, the centre plate 106 is held in relation to the baseplate 100 by a mechanism which permits rotation of the centre plate 106 and therefore of the router plate 104. This mechanism comprises a T-nut 124 which cooperates with the stepped groove in the baseplate 100 and into which a bolt 126 screws. The head of the bolt 126 rests in a circular button 122 which button has an outer flange 122*a* cooperating with a stepped aperture in the centre plate 106. Thus, when the bolt 126 is securely tightened into T-nut 124, the button 122 is held tightly against the baseplate 100. However, a slight tolerance is left between the button flange 122*a* and the centre plate 106 allowing the centre plate 106 and associated router plate 104 to rotate, if desired. Moreover, this also permits the router plate 104 to move backwards and forwards with the centre plate 106 sliding in groove 108. If the bolt 126 is loosened, the centre plate 106 can be moved in relation to the baseplate 100 thereby moving the axis 112 about which the router plate 104 rotates (see FIGS. 13*a*, *b* and *c*). The router plate 104 may rotate about the pivot point 112 between an extreme left and an extreme right hand position defined by dotted lines 116 and 117 which represent the extremes of movement of the router plate permitted by stops 118. Oblique cuts may be made in the material supported in the cutting position as described above in relation to FIG. 1. The backwards travel of the router 102 may be limited by an adjustable stop 151 which is an Alan key adjustable in a block 150 secured to the centre plate 106.

In FIG. 10, a piece of material in which a profile is to be cut, for example a wooden board 130 in the cutting position, is shown shortly after a cut perpendicular to the board 130 has been made by the router 102. Thus, the router 102 moves on the router plate 104 from the position shown by dotted lines 132 to the position shown by the solid line of the router plate 104. The cut is a dovetail slot. FIG. 11 is an elevation view of the parts shown in FIG. 10.

Turning now to the method by which a dovetail pin is cut, reference should be made to FIGS. 12 to 15. The router plate pivots between the positions set by the stops 118 about the pivot point 112 and two cuts are made, one at each of the opposite angles dictated by the position of the stops 118. Reference here should also be made to FIGS. 14 and 15. Thus, the router plate is caused to slide such that its edge contacts stop 118 along the entire length of its travel, therefore providing the cuts 132 and 134. It is to be noted here that the cutting angles are set to equal the angle of the previously cut tail to which the pin being machined will cooperate. As will be seen, the material 136 remaining between cuts constitutes the desired pin. The material between adjacent pins may be removed by simply moving the router back and forth through the material to be removed.

In FIGS. 13*a*, 13*b* and 13*c*, the effect of moving the pivot point 112, but maintaining the position of the stops 118 (i.e. the same cut angles) can be seen. Thus, the width of the pin can be adjusted. The width of the pin (W′, W″, and W‴,) can be made equal to the width of the base of the dovetail slot so that the slot and pin will fit perfectly. The arrangement is simple to operate and easily to adjust finally.

In FIGS. 16 and 17, the machined ends of two cooperating end profiles are shown. In FIG. 16, a profile having a series of dovetail slots 150 is shown whilst, in FIG. 17, the end profile comprises a series of dovetail pins 152 which cooperate with the slots 150. These end profiles may be machined using the apparatus of FIG. 1 or FIG. 8.

Finally, it is to be appreciated that the mechanism whereby the cutting means is movable with respect to the support about a movable axis is usable in respect of other machines in which material is cut by a cutting means, for instance a dovetail cutting machine having only one machining position.

I claim:

1. An apparatus for machining at least one half of an interconnecting joint between the end regions of two components, the apparatus comprising:

a support;

a carrier movable on and fixable with respect to the support and having a first clamping means, for clamping to the carrier a first component for machining of that component, and a second clamping means for clamping a second component, having a previously machined end profile, to the carrier in a predetermined position to act as a template to enable the end region of the first component to be machined to a profile capable of co-operating with the second component;

a cutting means mounted on the support for machining the end of the component; and means defining a datum point;

the arrangement being such that, in use, when the second component is sequentially held by the second clamping means in a series of predetermined positions in relation to the means defining a datum point, the first component to be machined is correspondingly held in a series of positions in relation to the cutting means whereby the end of the first component is capable of being machined by the cutting means to a profile capable of co-operating with the profile of the second component.

2. An apparatus according to claim 1, wherein each clamping means comprises a fixed jaw and a movable jaw between which the component to be clamped is received, the movable jaw having an associated camming mechanism whereby the movable jaw may be progressively tightened against a component received in the gap.

3. An apparatus according to claim 2, wherein the movable jaw and associated camming mechanism is movable along a toothed slide in the carrier and is lockable in positions along the toothed slide by a ratchet.

4. An apparatus according to claim 1, wherein said cutting means is mounted on a platform which is rotatable with respect to the support about an axis perpendicular to the longitudinal axis of the carrier, parallel to the plane of the carrier.

5. An apparatus according to claim 4, wherein the position of the axis of the platform is adjustable.

6. An apparatus as claimed in claim 5, wherein the platform is carried by a base plate mounted on the support.

7. An apparatus according to claim 6, wherein the baseplate includes stops for limiting the angle through which the platform may rotate.

8. An apparatus for machining at least one half of an interconnecting dovetail joint between the end regions of two co-operating components comprising:

a support;

a carrier movable and fixable with respect to the support and having a first clamping means for clamping to the carrier a first component for machining of that component, and a second clamping means for clamping a second component, having a previously machined end profile comprising a series of dovetail shaped slots, to the carrier in a predetermined position to act as a template to enable the end of the first component to be machined to a profile having a series of pins capable of co-operating with the profile of the second component;

cutting means for machining the pins in the said first component, said cutting means being mounted on the support such that it is movable in a plane perpendicular to the plane of the carrier and at angles inclined to the plane of the carrier; and a means defining a datum point;

the arrangement being such that, in use, when the second component is sequentially held by the second clamping means in a series of predetermined positions in relation to the means defining a datum point, the first component to be machined is correspondingly held in a series of positions in relation to the cutting means whereby the end of the first component is capable of being machined by the cutting means to a profile capable o co-operating with the profile of the second component.

9. An apparatus according to claim 8, wherein each clamping means comprises a fixed jaw and a movable jaw between which the component to be clamped is received, the movable jaw having an associated camming mechanism whereby the movable jaw may be progressively tightened against a component received in the gap.

10. An apparatus according to claim 9, wherein the movable jaw and associated camming mechanism is movable along a toothed slide in the carrier and is lockable in positions along the toothed slide by a ratchet.

11. An apparatus according to claim 8, wherein said cutting means is mounted on a platform which is rotatable with respect to the support about an axis perpendicular to the longitudinal axis of the carrier, parallel to the plane of the carrier.

12. An apparatus according to claim 11, wherein the position of the axis of the platform is adjustable.

13. An apparatus as claimed in claim 12, wherein the platform is carried by a base plate mounted on the support.

14. An apparatus according to claim 13, wherein the baseplate includes stops for limiting the angle through which the platform may rotate.

15. A method of machining at least one half of an interconnecting joint between two components which comprises the steps of:

(a) clamping a first component to be machined to a carrier movable and fixable with respect to a support and clamping to the carrier, at a location spaced from the first component, a second component which has a previously machined profile to which a mating profile is to be machined in the first component, the second component being clamped to the carrier in a manner such that its machined profile lies in a first predetermined position against a datum point on the support;

(b) fixing the carrier with respect to the support and machining a first region of the end of the first component using a cutting means mounted on the support;

(c) adjusting the position of the carrier with respect to the support such that the profile of the second component lies in a further predetermined position against said datum point;

(d) fixing the carrier with respect to the support in the adjusted position and machining a second region of the profile of the first component using the said cutting means; and (e) repeating steps (c) and (d) until the whole of the profile of the first component has been machined.

16. A method of machining at least one half of an interconnecting dovetail joint between the end regions of two components which comprises the steps of:

(a) clamping a first component to be machined on a carrier movable on and fixable with respect to a support and clamping to the carrier, at a location spaced from the first component, a second component which has a previously machined end profile comprising a series of dovetail-shaped slots to which a mating profile is to be machined in the first component, the second component being clamped to the carrier in a manner such that its previously machined end profile lies in a first predetermined position against a datum point on the support;

(b) fixing the carrier with respect to the support and machining a first region of the profile of the first component using a cutting means mounted on the support;

(c) adjusting the position of the carrier with respect to the support such that the profile of the second component lies in a further predetermined position against said datum point;

(d) fixing the carrier with respect to the support in the adjusted position and machining a second region of the profile of the first component using the cutting means; and (e) repeating steps (c) and (d) until the whole of the profile of the first component has been machined.

* * * * *